US006184194B1

(12) United States Patent
Arvanitidou et al.

(10) Patent No.: US 6,184,194 B1
(45) Date of Patent: Feb. 6, 2001

(54) HIGH FOAMING, GREASE CUTTING LIGHT DUTY LIQUID DETERGENT HAVING ANTIBACTERIAL PROPERTIES COMPRISING PROTON DONATING AGENT

(75) Inventors: Evangelia Arvanitidou, Kendall Park; David Suriano, Monroe Township; Amy Engels, Matawan; Gary Jakubicki, Robbinsville, all of NJ (US)

(73) Assignee: Colgate Palmolive Company, New York, NY (US)

( * ) Notice: Under 35 U.S.C. 154(b), the term of this patent shall be extended for 0 days.

(21) Appl. No.: 09/632,128

(22) Filed: Aug. 3, 2000

(51) Int. Cl.[7] ..... C11D 17/00

(52) U.S. Cl. ..... 510/426; 510/424; 510/428; 510/477; 510/490; 510/505; 510/508

(58) Field of Search ..... 510/424, 426, 510/428, 490, 477, 505, 508

(56) References Cited

U.S. PATENT DOCUMENTS

| | | | | |
|---|---|---|---|---|
| 3,970,596 | * | 7/1976 | Klisch et al. | 252/546 |
| 5,962,396 | * | 10/1999 | Pollack et al. | 510/433 |
| 6,004,920 | * | 12/1999 | Pollack et al. | 510/426 |
| 6,051,542 | * | 4/2000 | Pollack et al. | 510/426 |

* cited by examiner

*Primary Examiner*—Necholus Ogden
(74) *Attorney, Agent, or Firm*—Richard E. Nanfeldt

(57) ABSTRACT

A light duty, liquid comprising: a paraffin sulfonate, an alpha olefin sulfonate, a proton donating agent, a sultaine surfactant, a magnesium containing inorganic compound, and water.

5 Claims, No Drawings

HIGH FOAMING, GREASE CUTTING LIGHT DUTY LIQUID DETERGENT HAVING ANTIBACTERIAL PROPERTIES COMPRISING PROTON DONATING AGENT

BACKGROUND OF THE INVENTION

The present invention relates to novel light duty liquid detergent compositions with high foaming and good grease cutting properties, good mildness, as well as excellent disinfecting properties on hard surfaces.

The prior art is replete with light duty liquid detergent compositions containing nonionic surfactants in combination with anionic and/or betaine surfactants wherein the nonionic detergent is not the major active surfactant. In U.S. Pat. No. 3,658,985 an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8 to 20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition containing an alkali metal silicate, urea, glycerin, triethanolamine, an anionic detergent and a nonionic detergent. The silicate content determines the amount of anionic and/or nonionic detergent in the liquid cleaning composition. However, the foaming properties of these detergent compositions are not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

The prior art also discloses detergent compositions containing all nonionic surfactants as shown in U.S. Pat. Nos. 4,154,706 and 4,329,336 wherein the shampoo compositions contain a plurality of particular nonionic surfactants in order to affect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylenepolyoxyethylene nonionic detergent, an anionic surfactant, a fatty acid alkanolamide and a polyoxyalkylene glycol fatty ester. But, none of the exemplified compositions contain an active ingredient mixture wherein the nonionic detergent is present in major proportion which is probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monoethanolamide foam stabilizer.

SUMMARY OF THE INVENTION

It has now been found that a high foaming liquid detergent properties having antibacterial properties can be formulated with a paraffin sulfonate, an alpha olefin sulfonate, a sultaine surfactant, a $C_5$–$C_7$ alkylene glycol, a proton donating agent, magnesium ions, a $C_1$–$C_4$ alkanol, and water.

Accordingly, one object of this invention is to provide novel, high foaming, light duty liquid detergent compositions containing an alpha olefin sulfonate surfactant and a proton donating agent.

To achieve the foregoing and other objects and in accordance with the purpose of the present invention, as embodied and broadly described herein the novel, high foaming, light duty liquid detergent of this invention comprises a $C_4$–$C_7$ alkylene glycol, paraffin sulfonate, an alpha olefin sulfonate, a proton donating agent, a sultaine surfactant, magnesium ions, a $C_1$–$C_4$ alkanol, and water wherein the composition does not contain an alkyl benzene sulfonate surfactant, an ethoxylated alkyl ether sulfate surfactant, an alkyl sulfate, a poly (oxyethylene) diamine, an alkyl polyglucoside surfactant, wheat protein, polyethylene glycol, polypropylene oxide, a glycol ether solvent, an ethoxylated and/or propoxylated nonionic surfactant, an amine oxide surfactant, a mono- or di-saccharides, a polyoxyalkylene glycol fatty acid, a builder, a polymeric thickener, a clay, a fatty acid alkanolamide, abrasive, silicas, tricloscan, alkaline earth metal carbonates, alkyl glycine surfactant or cyclic imidinium surfactant wherein the composition has good grease cutting ability and disinfecting properties.

DETAILED DESCRIPTION OF THE INVENTION

The present invention relates to a light duty liquid detergent which comprises approximately by weight:

(a) 4% to 16% of a paraffin sulfonate surfactant;
(b) 10% to 30% of an alpha olefin sulfonate surfactant;
(c) 2% to 12% of a sultaine surfactant;
(d) 0. 1 to 3% of magnesium containing inorganic compound;
(e) 0.05% to 4% of a proton donating agent;
(f) 0 to 1%, more preferably 0.1% to .8% of a $C_4$–$C_7$ alkylene glycol, preferably hexylene glycol;
(g) 0 to 9%, more preferably 0.5% to 7% of a $C_1$–$C_4$ alkanol such as ethanol; and
(h) the balance being water wherein the composition does not contain a glycol ether solvent, an alkyl polyglucoside surfactant, polyethylene glycol, wheat protein, polypropylene oxide, an ethoxylated and/or propoxylated nonionic surfactant, an amine oxide surfactant, poly (oxyethylene) diamine, an alkyl benzene sulfonate surfactant, an ethoxylated alkyl ether sulfate surfactant, a polyoxyalkylene glycol fatty acid, a mono- or di-saccharides, a builder, a polymeric thickener, a clay, a fatty acid alkanol amide, abrasive, silicas, triclosan, alkaline earth metal carbonates, alkyl glycine surfactant, cyclic imidinium surfactant.

The $C_{12}$–$C_{20}$ paraffin sulfonates used at a concentration of 4 wt. % to 16 wt. %, more preferably 6 wt. % to 12 wt. % in the instant compositions may be monosulfonates or di-sulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos. 2,503,280; 2,507,088; 3,260,744 and 3,372,188 and also in German Patent 735,096. Such compounds may be made to specifications and desirably the content of paraffin sulfonates outside the $C_{14-17}$ range will be minor and will be minimized, as will be any contents of di- or poly-sulfonates.

The present invention also contains 10 wt. % to 30 wt. %, more preferably 12 wt. % to 26 wt. % of an alpha olefin sulfonates, including long-chain alkene sulfonates, long-chain hydroxyalkane sulfonates or mixtures of alkene sulfonates and hydroxyalkane sulfonates. These alpha olefin sulfonate surfactants may be prepared in known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred alpha olefin sulfonates contain from 14 to 16 carbon atoms in the R alkyl group and are obtained by sulfonating an a-olefin. Vinylidene olefin sulfonate could be added to partially replace some of the alpha olefin sulfonate for viscosity reduction of the paste-like high active alpha olefin sulfonate material.

The composition also contains about 2 to about 12 wt. %, more preferably about 4 to about 10 wt. % of a sultaine which is preferably a cocoamido-propyl dimethyl hydroxy sultaine. The sultaine can be depicted by the formula:

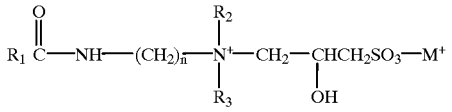

wherein $R_1$ is a saturated or unsaturated alkyl group having about 6 to about 24 carbon atoms, $R_2$ is a methyl or ethyl group, $R_3$ is a methyl or ethyl group, $M^+$ is about 1 to about 6, and n+is an alkali metal cation. The most preferred hydroxysultaine is an alkali metal salt of cocoamidopropyl dimethyl hydroxysultaine.

The instant compositions contain about 0.05 wt. % to about 4 wt. %, more preferably 0.25 wt. % to 3 wt. % of a proton donating agent, wherein the proton donating agent is selected from the group consisting of organic acids, preferably hydroxy aliphatic organic acids, and inorganic acids and mixtures thereof. The inorganic acids are selected from the group consisting of hydrochloric acid, hydrobromic acid, sulfuric acid, sulfurous acid and nitric acid. The organic acids are selected from the group consisting of succinic acid, adipic acid, glutaric acid, malic acid, maleic acid, lactic acid, citric acid, glycolic acid, salicylic acid and ortho hydroxy benzoic acid, wherein lactic acid is preferred.

The magnesium inorganic compound used at a concentration of 0.1 wt. % to 3 wt. %, more preferably 0.25 wt. % to 2 wt. % in the instant composition is a magnesium chloride, oxide, sulfate. The magnesium salt or oxide provides several benefits including improved cleaning performance in dilute usage, particularly in soft water areas. Magnesium chloride, either anhydrous or hydrated (e.g., hexahydrate), is especially preferred as the magnesium salt. Good results also have been obtained with magnesium oxide, magnesium sulfate, magnesium acetate, magnesium propionate and magnesium hydroxide. These magnesium salts can be used with formulations at neutral or acidic pH since magnesium hydroxide will not precipitate at these pH levels. The present invention can also optionally contain 0.05% to 2% of an alkali metal halide such as sodium chloride.

The magnesium salt not only offers benefits in grease cleaning, but also for alpha olefin sulfonate containing formulations it offers significantly better skinning properties. Skinning is a common phenomenon observed in dishliquid formulations, and it describes the formation of a thin layer on top of the formulation when it is exposed to air. This could cause serious problems in manufacturing for example. Sometimes stirring can take care of the problem, but in alpha olefin containing formulations, a gel phase is formed on top (upon air exposure), which does not disappear after stirring. Magnesium chloride haxahydrate disrupts the gel structure, and significantly improves skinning of the dishliquid formulation.

In addition to, the presence of magnesium chloride hexahydrate aids in viscosity reduction and cloud point reduction, are desirable for the instant formulations.

Sodium chloride offers skinning benefits as well, but not to the same extent as magnesium chloride hexahydrate, as seen in Example 1.

The compositions also contain 0 to 1 wt. %, more preferably 0.05 wt. % to 0.8 wt. % C4–C7 alkylene glycol, preferably hexylene glycol. Hexylene glycol is not only used as a solubilizing agent, but also assists in breaking the gel structure formed upon exposure to air. As seen in Example 1, a formula containing hexylene glycol along with magnesium chloride exhibits better a skinning score.

The water is present at a concentration of 40 wt. % to 83 wt. %. In addition to the previously mentioned essential and optional constituents of the light duty liquid detergent, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; sequestering agents such as ethylene diamine tetraacetates; pH modifiers; etc. The proportion of such adjuvant materials, in total will normally not exceed 15% by weight of the detergent composition, and the percentages of most of such individual components will be a maximum of 5% by weight and preferably less than 2% by weight. Sodium formate or formalin or Quaternium15(Dowcil75) can be included if necessary, in the formula as a perservative at a concentration of 0.1 to 4.0 wt. %. Sodium bisulfite can be used if necessary, as a color stabilizer at a concentration of 0.01 to 0.2 wt. %.

The present light duty liquid detergents such as dishwashing liquids are readily made by simple mixing methods from readily available components which, on storage, do not adversely affect the entire composition. Solubilizing agent such as sodium chloride and/or sodium xylene or sodium xylene sulfonate can be used in conjunction with the $C_1$–$C_4$ alkanol to assist in solubilizing the surfactants. The viscosity of the light duty liquid composition desirably will be at least 100 centipoises (cps) at room temperature, but may be up to 1,000 centipoises as measured with a Brookfield Viscometer using a number 21 spindle rotating at 20 rpm. The viscosity of the light duty liquid composition may approximate those of commercially acceptable light duty liquid compositions now on the market. The viscosity of the light duty liquid composition and the light duty liquid composition itself remain stable on storage for lengthy periods of time, without color changes or settling out of any insoluble materials. The pH of the composition is 2.7 to 5 preferably 2.9 to 4.0. The pH of the composition can be adjusted by the addition of NaOH to the composition.

The instant compositions exhibit excellent foam volume and foam longevity properties. They have a minimum foam volume of 380 mis after 40 rotation at 25° C. as measured by the foam volume test using 0.033 wt. % of the composition in 150 ppm of water. Their foam longevity as measured by the above test upon addition of soil, is at least 170 ml after 40 rotation at 25° C. as measured by the foam volume test using 0.033 wt. % of the composition in 150 ppm of water.

The compositions also exhibit antibacterial properties and good grease removal profiles.

Skinning of the formulations were measured based on a scale from 1 to 10, where 1=almost no skinning and 10=gel phase, severe skinning. Skinning determination took place after 30 minutes of air exposure.

The following examples illustrate liquid cleaning compositions of the described invention. Unless otherwise specified, all percentages are by weight. The exemplified compositions are illustrative only and do no limit the scope of the invention. Unless otherwise specified, the proportions in the examples and elsewhere in the specification are by weight.

DESCRIPTION OF THE PREFERRED EMBODIMENTS

EXAMPLE 1

The following formulas were prepared at room temperature by simple liquid mixing procedures as previously described

| | A (% Al) | B (% Al) | C (% Al) | D | Control |
|---|---|---|---|---|---|
| Paraffin sulfonate | 11.01 | 11.01 | 11.01 | 11.01 | |
| Alpha olefin sulfonate | 22.03 | 22.03 | 22.03 | 22.03 | |
| Cocoamidopropyl hydroxy sultaine | 6.96 | 6.96 | 6.96 | 6.96 | |
| Magnesium chloride | 1.06 | 1.06 | 1.06 | 1.06 | |
| Ethanol | 5.4 | 6.0 | 6.0 | 6.0 | |
| Hexylene glycol | 0.6 | 0.5 | 0.5 | 0.5 | |
| Perfume | 0.45 | 0.45 | 0.45 | 0.45 | |
| Lactic acid | 2.0 | 2.0 | 2.0 | 2.0 | |
| Sodium chloride | | | 0.5 | | |
| Color | 0.18 | 0.18 | 0.18 | 0.18 | |
| Water | Bal. | Bal. | Bal. | Bal. | |
| pH | 3.5 | 3.5 | 3.5 | 3.5 | |
| Cloud point F. ° | 27 | 29 | 34 | 38.5 | 26 |
| Skinning | 2 | 4 | 5 | 10 | 6 |

[1]Scale 1 to 10 1-almost no skinning; 10-gel

What is claimed is:

1. A light duty liquid detergent composition comprising approximately by weight:

(a) 4% to 16% of a $C_{10}$–$C_{20}$ paraffin sulfonate;

(b) 10% to 30% of an alpha olefin sulfonate;

(c) 2% to 12% of a sultaine surfactant;

(d) 0.05% to 4% of a proton donating agent selected from the group consisting of lactic acid, salicylic acid and/or citric acid;

(e) 0.1% to 3% of a magnesium containing inorganic compound;

(f) 0.05 to 0.8% by weight of a C4–C7 alkylene glycol; and (g) the balance being water.

2. A light duty liquid composition according to claim 1 which further includes a $C_1$–$C_4$ alkanol.

3. A light duty liquid composition according to claim 1 further including a preservative.

4. A light duty liquid composition according to claim 1 further including a color stabilizer.

5. A light duty liquid cleaning composition according to claim 1 wherein said magnesium containing inorganic compound is magnesium chloride.

* * * * *